US012139290B2

(12) United States Patent
Bongers

(10) Patent No.: US 12,139,290 B2
(45) Date of Patent: Nov. 12, 2024

(54) CARTONING MACHINE SYSTEM AND METHOD FOR CARTONING A PRODUCT

(71) Applicant: ECS-ENGINEERING CONSULTING SERVICES, Laupheim (DE)

(72) Inventor: Hans-Werner Bongers, Laupheim (DE)

(73) Assignee: ECS-ENGINEERING CONSULTING SERVICES, Laupheim (DE)

( * ) Notice: Subject to any disclaimer, the term of this patent is extended or adjusted under 35 U.S.C. 154(b) by 56 days.

(21) Appl. No.: 17/917,544

(22) PCT Filed: Apr. 7, 2020

(86) PCT No.: PCT/EP2020/059909

§ 371 (c)(1),
(2) Date: Oct. 6, 2022

(87) PCT Pub. No.: WO2021/204367

PCT Pub. Date: Oct. 14, 2021

(65) Prior Publication Data

US 2023/0142537 A1 May 11, 2023

(51) Int. Cl.
*B65B 61/26* (2006.01)
*B65B 35/30* (2006.01)
*B65B 65/00* (2006.01)

(52) U.S. Cl.
CPC ..... *B65B 61/26* (2013.01); *B65B 35/30* (2013.01); *B65B 65/003* (2013.01)

(58) Field of Classification Search
CPC ..... B65B 35/30; B65B 57/00; B65B 61/26
USPC ..... 53/396, 443, 467, 411
See application file for complete search history.

(56) References Cited

U.S. PATENT DOCUMENTS 4,317,399 A * 3/1982 Romagnoli ..... B65B 61/065 83/237
4,506,495 A * 3/1985 Romagnoli ..... B29C 51/30 53/559
7,581,242 B1 * 8/2009 Oget ..... G06K 5/00 726/16
2002/0026768 A1 * 3/2002 Duncan ..... B65B 25/008 209/583
2002/0069616 A1 6/2002 Odell et al.
2002/0117405 A1 * 8/2002 Wang ..... B65B 25/008 206/459.5
2003/0083890 A1 * 5/2003 Duncan ..... G06Q 10/087 705/28
2003/0089078 A1 * 5/2003 Cristina ..... B65B 59/003 53/55
2006/0025883 A1 * 2/2006 Reeves ..... G06Q 10/08 700/216
2006/0219782 A1 * 10/2006 Wong ..... G06Q 50/40 235/462.13
2007/0219916 A1 * 9/2007 Lucas ..... G06Q 10/08 705/58
2009/0179072 A1 * 7/2009 Szesko ..... G16H 20/13 235/375
2012/0292383 A1 * 11/2012 Leinicke ..... G09B 5/062 235/375
2014/0149131 A1 * 5/2014 Bear ..... G16H 20/10 705/2
2014/0379608 A1 * 12/2014 Buettner ..... G06Q 10/0838 705/341
2015/0102100 A1 * 4/2015 Hattrup ..... G06K 15/1835 53/64
2015/0210410 A1 7/2015 Umeno et al.
2015/0302152 A1 * 10/2015 Lyons ..... G06F 16/9554 235/375
2015/0302344 A1 * 10/2015 Lyons ..... G08B 21/24 705/2
2016/0371512 A1 * 12/2016 Hattrup ..... G06K 15/024
2018/0025185 A1 * 1/2018 Hattrup ..... G06K 15/1859 705/14.1
2019/0256336 A1 8/2019 Takaku et al.
(Continued)

FOREIGN PATENT DOCUMENTS

CN 106628440 A 5/2017
EP 2407417 1/2012
(Continued)

OTHER PUBLICATIONS

Assort—definition, retrieved from URL https://www.merriam-webster.com/dictionary/assort on Feb. 24, 2024 (Year: 2024).*
Code—definition, retrieved from URL https://www.merriam-webster.com/dictionary/code on Feb. 24, 2024 (Year: 2024).*
Determine—definition, retrieved from URL https://www.merriam-webster.com/dictionary/DETERMINE on Feb. 24, 2024 (Year: 2024).*
Label—definition, retrieved from URL https://www.merriam-webster.com/dictionary/LABEL on Feb. 24, 2024 (Year: 2024).*
Readable—definition, retrieved from URL https://www.merriam-webster.com/dictionary/READABLE on Feb. 24, 2024 (Year: 2024).*
Print—definition, retrieved from URL https://www.merriam-webster.com/dictionary/PRINT on Feb. 24, 2024 (Year: 2024).*
(Continued)

*Primary Examiner* — Valentin Neacsu
(74) *Attorney, Agent, or Firm* — Meunier Carlin & Curfman LLC

(57) ABSTRACT

A cartoning machine system for cartoning medical products, comprising a product input module for introducing a product into the cartoning machine system; a product processing module, wherein the product processing module receives at least one product from the product input module and wherein the product processing module is configured to process the at least one product, a product cartoning module configured to carton the at least one processed product to obtain at least one cartoned processed product; and a product information module configured to print a code on the product and/or the at least one processed product; and wherein the cartoning machine system is without a package insert inserting module for inserting a package insert to the at least one cartoned processed product.

20 Claims, 3 Drawing Sheets

(56) References Cited

U.S. PATENT DOCUMENTS

| | | | | |
|---|---|---|---|---|
| 2020/0065826 | A1* | 2/2020 | Gering | G06K 7/1094 |
| 2020/0265446 | A1* | 8/2020 | Vargas | G06Q 10/08 |
| 2021/0130023 | A1* | 5/2021 | Stephens | B65B 61/26 |
| 2023/0142537 | A1* | 5/2023 | Bongers | B65B 65/003 53/396 |

FOREIGN PATENT DOCUMENTS

| | | | |
|---|---|---|---|
| EP | 2742926 | A1 | 6/2014 |
| IT | LT20120006 | A1 | 12/2013 |
| JP | 2008087834 | A | 4/2008 |
| WO | 2012174545 | A1 | 12/2012 |

OTHER PUBLICATIONS

International Search Report and Written Opinion in International Application No. PCT/EP2020/059909, mailed Dec. 3, 2020, 12 pages.

Office Action in connection to EP Application No. 20719364.0, dated May 21, 2024. 5 pages.

* cited by examiner

CARTONING MACHINE SYSTEM AND METHOD FOR CARTONING A PRODUCT

CROSS REFERENCE TO RELATED APPLICATIONS

This application is a United States National Phase Patent Application of International Patent Application Number PCT/EP2020/059909, filed on Apr. 7, 2020.

FIELD OF INVENTION

Embodiments of the present disclosure relate to cartoning machines. In particular, embodiments of the present disclosure relate to cartoning machines for cartoning medication, e.g. for forming a carton, inserting packaged medication and sealing the carton for shipping.

BACKGROUND

Cartoning machines provide means of packaging products into adequate packaging, such as for example blisters, bottles, vials, tubes, etc. and automate cartoning of these products for transportation and sale. However, packaging for pharmaceutical markets underlies strict regulations for the packaging environment, such as e.g. particle sizes and particle numbers of airborne particles. Further, cartoning machines are designed to print necessary information about the product on parts of the product or packaging within the same packaging process.

Accordingly, in view of the above, there is a demand for improved cartoning machines which at least partially overcome the problems of the state of the art.

SUMMARY

In light of the above, a cartoning machine system and a method of operating the cartoning machine system is provided. Further aspects, advantages, and features are apparent from the dependent claims, the description, and the accompanying drawings.

According to an aspect, a cartoning machine system for cartoning medical products is provided. The system includes a product input module for introducing a product into the cartoning machine system, a product processing module, wherein the product processing module receives at least one product from the product input module and wherein the product processing module is configured to process the at least one product, a product cartoning module configured to carton the at least one processed product to obtain at least one cartoned processed product, and a product information module configured to print a code on the product and/or the at least one processed product, wherein the cartoning machine system (100) is without a package insert inserting module for inserting a package insert to the at least one cartoned processed product.

Accordingly, beneficially a cartoning machine system is provided which can be operated without a package insert inserting module. Package insert inserting modules or inserting modules contribute to the particle rate in a production and/or packaging environment. Thus, the cartoning machine system of the present disclosure enables the customer to use the cartoning machine system in a clean room with a higher rating, compared to cartoning machines comprising a folding machine module.

According to a further aspect, a method for cartoning a product is provided. The method includes acquiring product entity information, the product entity information being representative for a product to be cartoned, determining a code based on the product entity information, and cartoning the processed product without including a folded package insert.

Accordingly, beneficially a method is provided which provides the user with a cartoning machine system that releases less particles into the surrounding due to product information being provided digitally, without the need of folding a package insert and thus without releasing particles through folding. Accordingly, the user may cost effectively switch between multi-stage and single-stage applications.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment can apply to a corresponding part or aspect in another embodiment as well.

According to embodiments, a cartoning machine system is provided. The cartoning machine system includes a product input module, a product processing module, a product cartoning module and a product information module. A cartoning machine system according to embodiments is exemplarily shown in FIG. 1.

According to embodiments, the cartoning machine system includes a product input module 110. The product input module may be configured to provide one or more products to the cartoning machine system. The one or more products may include solid products or fluid products. The fluid products may include liquid and/or gaseous products. A solid product may e.g. include tablets, pills or the like. The fluid products may include solutions, lotions or the like. The products may include pharmaceutical grade products, i.e. products including a certain degree of purity or products that are free from chemical or biological contaminants for the use with a patient. Furthermore, the products may include all sorts of medical products or pharmaceuticals.

Figure 1:
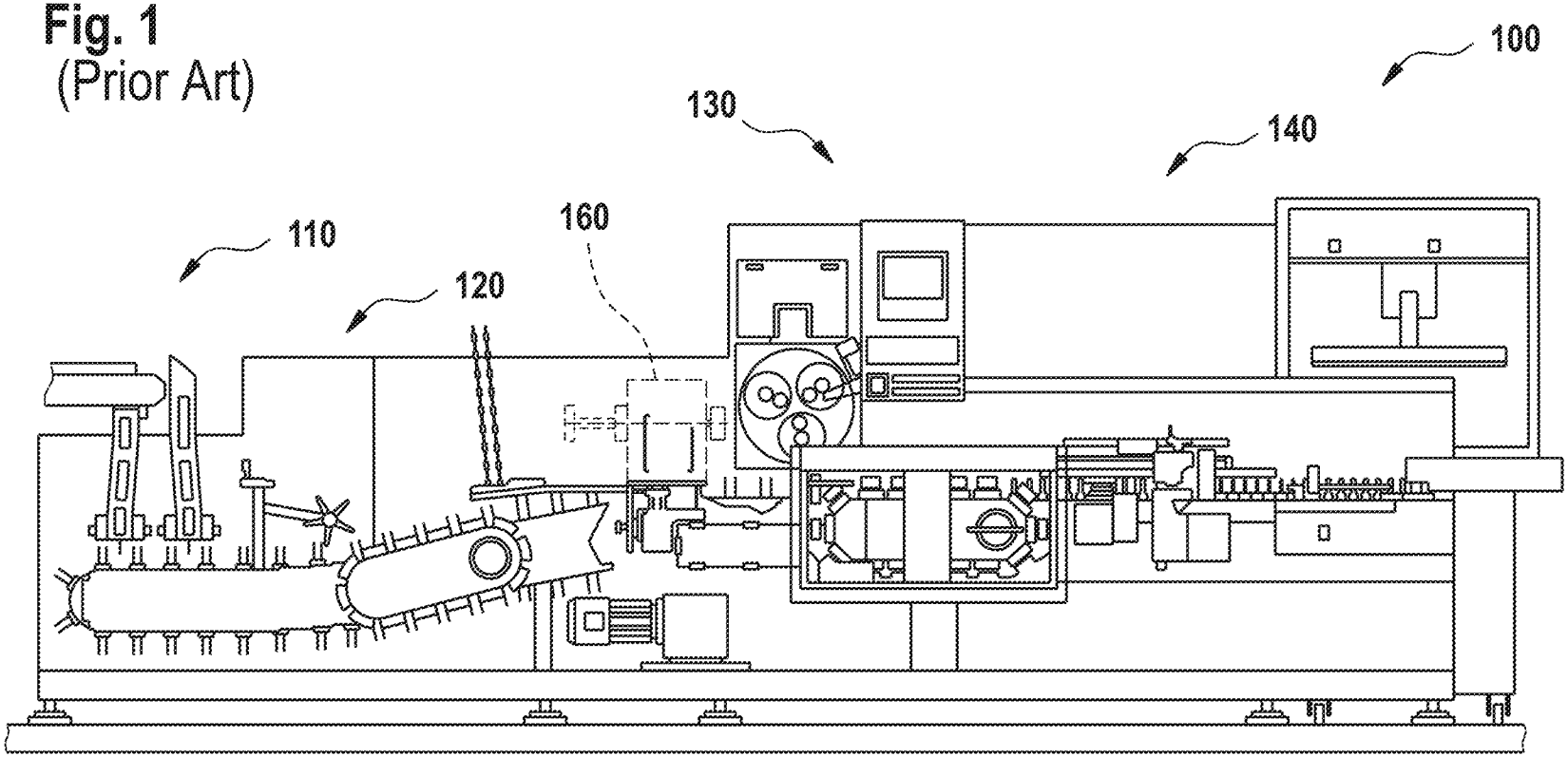
Fig. 1 (Prior Art)
FIG. 1 shows a schematic side view of a cartoning machine system according to embodiments described herein.

According to embodiments described herein, the product input module may be adapted according to the respective product to be provided. For example, when a solid product is provided, the product input module may be equipped such that the solid product may be processed further in the cartoning machine system. FIG. 1 may be regarded as an example for providing a solid product. Likewise, when a fluid product is provided, the product input module may be equipped such that the fluid product may be processed further in the cartoning machine system.

According to embodiments described herein, the product input module 110 may be configured to forward the product to the product processing module 120. For example, the products may be forwarded via robots, tubes, conveyor belts or the like. The product processing module 120 is configured to process the product received from the product input module 110. The processing module may be configured to provide a first packaging to the product. The first packaging may include blister packs, medicine cans, dosage aerosol cans, dispensers and the like. Thus, solid and/or fluid products may receive a first packaging in the product processing module. This may also include the product being filled into the first packaging. Accordingly, the product processing module may be configured to provide a processed product.

According to embodiments described herein, the product processing module may further be configured to provide a number of products into the first packaging. For example, the product processing module may be configured to sort and/or measure a number of products into blister packs and to seal the blister packs. Further exemplarily, the product processing module may be configured to measure and fill a number of products into the medicine cans and/or dosage aerosol cans and to close the medicine cans.

According to embodiments, the processed product may be forwarded to a product cartoning module 130. In other words, the product cartoning module 130 may be configured to receive a processed product from the processing module 120. The product cartoning module may be configured to provide a second packaging to the product, i.e. a packaging to the processed product. The second packaging may include packaging made from cardboard, cartons and the like. The second packaging may provide protection to the processed product. Advantageously, the second packaging may provide a certain shape to the processed product, such that for example, the cartoned product may be stacked onto pallets, placed into shipping containers or the like.

Generally in the art, a cartoning machine includes a folding machine module (reference numeral 160 in FIG. 1, the folding machine module being depicted in broken lines). A folding machine module is normally used for folding a package insert. Such package insert may e.g. be a leaflet. Normally, the packaging insert or the folded leaflet is provided to the product cartoning module where the packaging insert normally is introduced into the second packaging. The packaging insert or the leaflet may include product information, i.e. security information, dosage information, information about adverse effects, and the like.

As used throughout the present disclosure, the term "package insert" or "folded package insert" may refer to package leaflet, as required by the European Medicines Agency according to the summary of product characteristics (SmPC). "Package insert" may also refer to a Food and Drug Administration (FDA) required document.

"Product information" as used herein may refer to the information contained in a package insert, as for example required by the European Medicine Agency or the FDA. "Product information" may contain additional information concerning the product, such as for example security information for tamper proofing the product or information linking to additional services for the associated product.

Advantageously, the cartoning machine system as described herein may be without a package insert inserting module. Such modules are generally used for inserting paper-based package inserts into a carton of a cartoned product. Paper-based package insert can be delivered to a cartoning machine in a pre-folded manner and then the inserted into a carton. However, the cartoning machine system as described herein is without a package insert inserting module and may thus not have to be provided with pre-folded paper-based package inserts. As an advantage, there is less handling required when no paper-based package inserts need to be delivered to a cartoning machine system and further, a cartoning machine system in a clean room environment may have a higher rating for the cleanroom, as there is less material to be brought into the cleanroom. The system may be configured to not provide a package insert.

Advantageously, the cartoning machine system as described herein, is free from a folding machine module. In other words, the cartoning machine system does not include a folding machine module or the cartoning machine system is without a folding machine module. Advantageously, the cartoning machine system may still provide at least the product information that may normally be provided by the packaging insert. A cartoning machine system that does not include a folding machine module but that may still provide the product information provided by the folded packaging insert may provide several advantages. Folding machines or folding modules contribute to the particle rate in a production and/or packaging environment. Thus, the cartoning machine system of the present disclosure enables the customer to use the cartoning machine system in a clean room with a higher rating, compared to cartoning machines comprising a folding machine module.

Advantageously, in a cartoning machine system being free from, e.g. not having, a folding machine module, the generation of particles is reduced. Thus, in a cartoning machine system without a folding machine module the overall particle load within the cartoning machine system is reduced. Accordingly, contamination of the product, the processed product and/or the cartoned processed product can be avoided or reduced such that the cartoning machine system can be used for applications that require low particle load in a packaging system and/or packaging environment. The cartoning machine system may be configured to not provide a folded package insert to the at least one cartoned processed product.

Accordingly, the cartoning machine system of the present disclosure enables the customer to use the cartoning machine system in a clean room with a higher rating, compared to cartoning machines comprising a folding machine module.

According to embodiments described herein, the cartoning machine system includes a product information module 140. The product information module is configured to print a code on the product and/or the at least one processed product. The product printing module may include a module selected from the group consisting of a lasing module or a printing module for lasing or printing the code on the product and/or the processed product. The product information module may include a first printing module arranged at the product input module and may include a second printing module arranged at the product cartoning module. The product printing module may include a laser, a printer and/or an engraver or the like. The product printing module may further be configured to carry out offset printing, inkjet printing, xerography or transfer printing or a combination thereof.

Accordingly, printing as used herein may refer to adding the code to the product or the processed product through removal (lasing) or adding (printing) material on the product or the processed product.

In particular, the first printing module may be used in the cartoning machine system when solid products are processed. For example, a code may be printed on a solid product, e.g. a pill which may then be further processed, for example, the solid product may be packed or placed into a first packaging e.g. a blister or the like.

According to embodiments, the product printing module, i.e. the first printing module may be configured to print a code on a processed product. In other words, the first printing module may be configured to print a code on a first packaging.

According to embodiments that can be combined with any other embodiment described herein, the product printing module is configured to print a code on a second packaging i.e. to print a code on the packaging of the processed product. The product printing module may be configured to print the code onto any position of the second packaging, e.g. if a box is used as a second packaging, the product printing module may be configured to print a code on all sides, to the top and/or the bottom of the box or at least one side.

Additionally or alternatively, the product printing module may include a labelling module for labeling the code onto the processed product, i.e. onto the second packaging. The labelling module may provide a label to the second packaging. For example, the label may be a self-adhesive label.

A "module" as used herein may refer to an integral part of the machine system or the machine or it may refer to a module in the sense of an industry 4.0 module that can be "plug and played" by adding it to a machine system or production/packaging line.

According to embodiments described herein, the code may be a readable code. For example, the code may be one of a QR code, a bar code, or an embedded system code such as for example a code available through an RFID tag. The code may provide access to a computer. For example, the code may provide access to a cloud space where the product information according to the product being cartoned is stored.

Advantageously, the code may provide product information related to the at least one cartoned processed product, particularly selected from the group consisting of application information, safety information, dosage, adverse effects information and/or combinations thereof. Thus, the product information can be available worldwide by scanning or recognizing the code with a code scanning device. For example, if the code is a QR code, a smart phone including a respective software program for the recognition of the QR code (QR code scanner) can be used to obtain the product information associated with the code from the product, the processed product and/or the cartoned processed product.

Advantageously, the information accessible via the code can be updated i.e. the product information linked to the code can (continuously) be renewed or developed. For example, via a remote access to the computer, the product information, i.e. security information, dosage information, adverse effects and the like can be renewed or updated. Advantageously, the product user can be provided with the latest product information without the need of providing an updated package insert. Accordingly, and further advantageously, the continual provision of the product is cheaper and more user friendly.

According to embodiments that can be combined with any other embodiment described herein, the cartoning machine system may include a computer adapted to store and/or provide information associated with the code. The computer may be, for example, an embedded computing system, a remote computer, such as e.g. a server or a cloud computer. The computer may have computer memory adapted to centrally store product information for e.g. more than a million products and/or the computer may have computer memory to store product information decentrally, i.e. a decentral manner.

Figure 2:
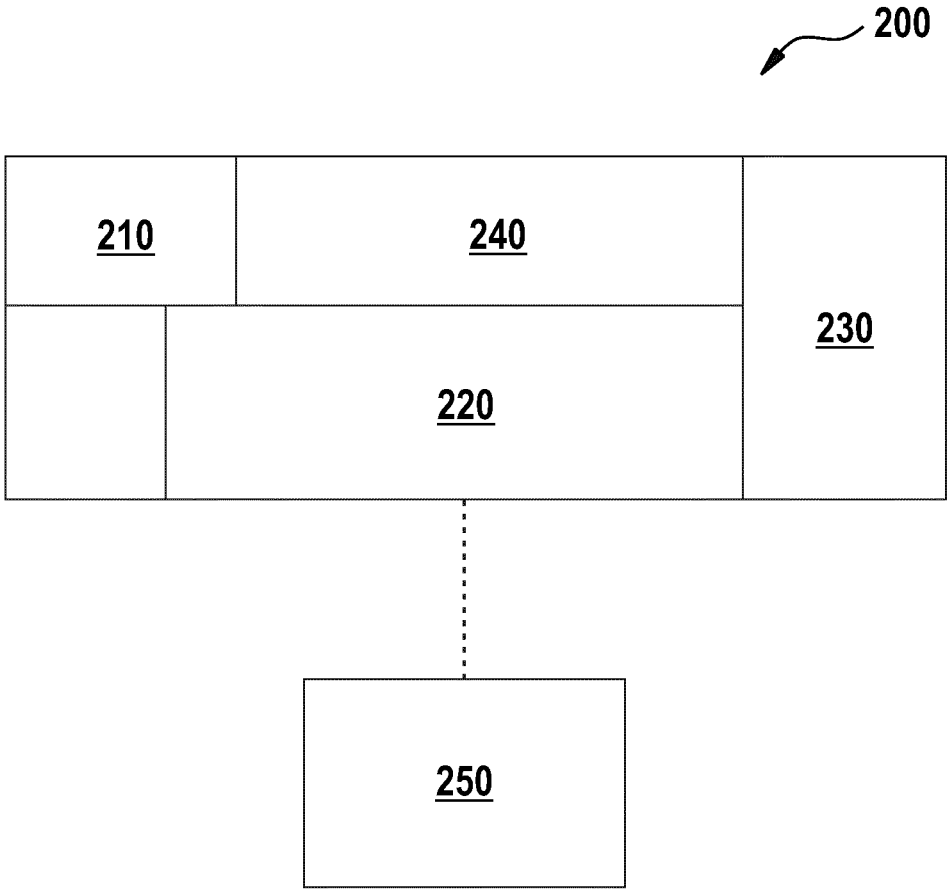
FIG. 2 shows a schematic view of a cartoning machine system according to embodiments described herein.

According to embodiments described herein and with exemplary reference to FIG. 2, a cartoning machine system is described. The system includes a product input module 210, a product processing module 220, a product cartoning module 230 and a product information module 240, the cartoning machine system not including a folding machine module. The modules may include the embodiments as described with respect to FIG. 1. The exemplary cartoning machine system of FIG. 2 is schematically shown without a folding machine module.

According to embodiments that can be combined with any other embodiment described herein, the product input module 210 may include a register module for obtaining one or more parameters from the at least one product. The information that is obtained by the register module may include the one or more parameters obtained from the at least one product. Thus, the one or more parameters may be stored on the computer as described according to embodiments herein. The one or more parameters obtained from the at least one product may include at least one parameter selected from the group consisting of amount, size, weight, shape and optical properties and/or combinations thereof.

According to embodiments described herein, the register module may include a camera system or a mechanical sensing system for analyzing the at least one product for obtaining the one or more parameters, such as product entity information. Advantageously, the one or more parameters of the at least one product may be measured when the at least one product enters the cartoning machine system. Accordingly, the one or more parameters can be directly allocated to the respective product that is cartoned in the cartoning machine system.

According to embodiments described herein, the product information module may include a validation system for checking the cartoned processed product, i.e. the processed product having a second packaging and the printed or labelled code. Advantageously, the cartoning machine system can thus check whether the code is provided correctly on the cartoned processed product and/or whether the code provides access to the product information correctly. Accordingly, the validation system may include a code reading system, a camera system and the like and may be connected to a computer for reading the code.

According to embodiments that can be combined with any other embodiment described herein, when the product and/or the processed product is provided with a code, the validation system may be configured to check the code provided on the product and/or the processed product.

According to embodiments, the product input module may be configured to assort more than one products when more than one of the at least one product is introduced into the product input module. For example, the product input module may assort a specific amount of products to the first packaging. Thus, different amounts of the at least one product can be processed i.e. the cartoning machine system may be configured to provide different sizes of the first packaging, e.g. differently sized blisters. The system may further be configured to provide different sizes of the second packaging, e.g. different amounts of the processed product can be provided with the second packaging.

Figure 3:
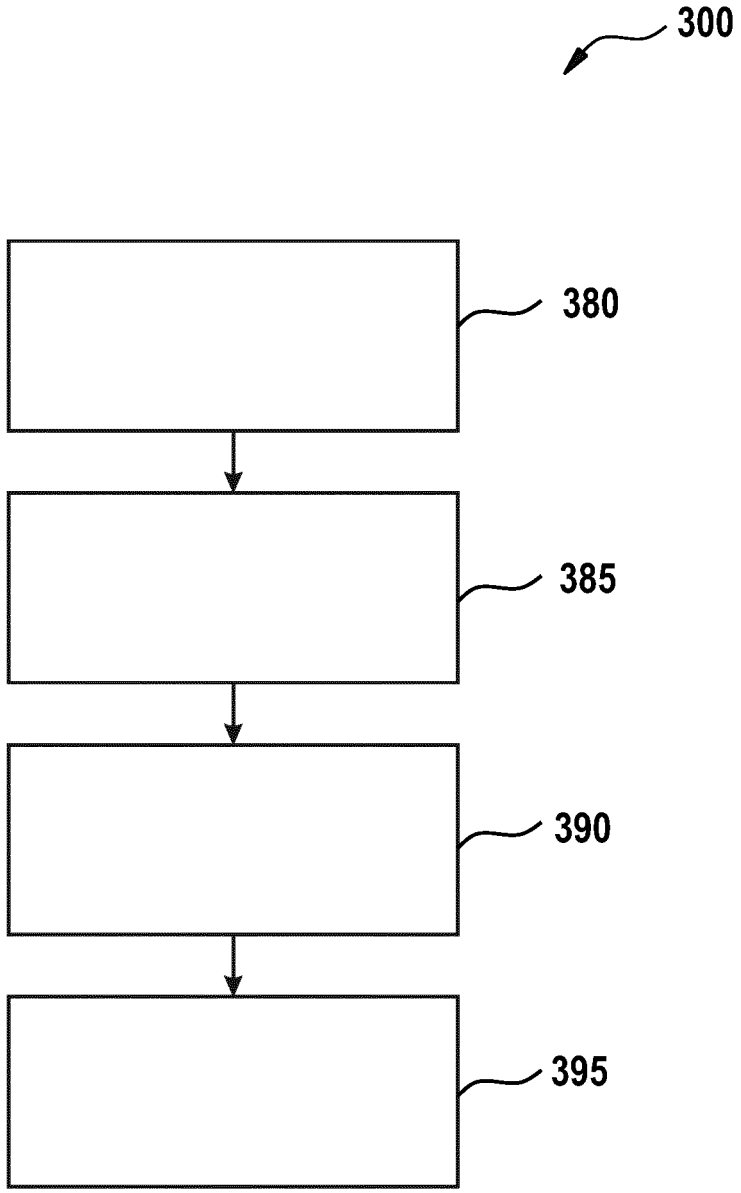
FIG. 3 shows a flow diagram of a method according to embodiments described herein.

For better understanding, with reference to FIG. 3 a method 300 for cartoning a product (or a medical product) according to embodiments described herein is described. The method includes acquiring 380 product entity information, the product entity information being representative for a product to be cartoned. For example, the product entity information may describe the product to be cartoned, i.e. may provide characteristic information about the respective product, processed product and/or cartoned processed product.

The method 300 further includes determining 385 a code based on the product entity information. The code may be a readable code as described according to embodiments herein. Each code may be allocated to a specific product to be processed in the cartoning machine system. Advantageously, the code may not only provide product information as described according to embodiments herein, but may also provide specific characteristics for the respective product that is cartoned. For example, the code may provide the information acquired by the register module. Thus, every code can be allocated to a specific product thereby enhancing security for the user of the product. Further advantageously, when the code is provided to the product, the processed product and the cartoned processed product, a line of correspondence can be provided. The line of correspondence is to be understood as a line of information about a specific product where every information provided can be verified and where all steps of cartoning the product can be tracked while cartoning and also afterwards. Thus, security for the product user is increased.

The method 300 may further comprise not providing 390 a folded package insert by printing the code onto the product and/or a first packaging of the product to obtain a processed product. Advantageously, not providing the folded package insert facilitates the provision of product information and/or product entity information to the product user. The product user can simply read the code with a respective device, e.g. a QR code with a QR code reader on a smartphone, and thus can easily access the information associated with the specific product in the packaging.

The method 300 further includes cartoning 395 the processed product without including a folded package insert. By replacing the folded package insert with the code, the provision of a folded, or even unfolded, package insert when cartoning the processed product can be omitted. Thus, a decrease in the need of material can be achieved. Further advantageously, the folding machine module for folding and providing a folded package insert to the cartoning machine system can be omitted as well, thus significantly reducing the load of unwanted particles in the cartoning machine system.

According to embodiments, the method 300 may further include issuing the code to a computer. Issuing the code to a computer may include reading of the code with a respective software program. Further, issuing the code to a computer may include storing the product information and/or the product entity information on a computer, e.g. a cloud computer. Accordingly and according to embodiments, the method 300 may further include determining a product information to be provided with the code by the computer and storing the product information associated with the code.

According to embodiments, the method 300 may further include updating the product information linked to the code. For example, via a remote access to the computer, the product information, i.e. security information, dosage information, adverse effects and the like can be renewed or updated. Advantageously, the product user can always be provided with the latest product information without the need of providing an updated package insert. Accordingly, and further advantageously, the continual provision of the product is cheaper and more user friendly.

According to embodiments, printing of the code may include at least one of lasing, printing and engraving as described according to embodiments herein. Printing may further include offset printing, inkjet printing, xerography or transfer printing.

According to embodiments that can be combined with any other embodiment described herein, determining of the code may further include determining of an encoding scheme for the code for providing product tamper proofing. An encoding scheme may for example refer to cryptographic methods, such as establishing encryption and/or an authorization scheme for access to the product information and/or product entity information associated with the code. It may further encompass protecting the information associated with the code from being altered, updated or the like by unauthorized persons. Further, it may encompass that the packaging used for the product or the processed product is not reused or only used once in order to provide the buyer/customer with the information that the bought product is a genuine product.

According to embodiments, the method may further comprise not providing a package insert to the at least one cartoned product. The method does not comprise providing a pre-folded package insert to the at least one cartoned product nor does the method comprise folding a package insert to provide it to the at least one cartoned product.

Beneficially, the cartoning machine system according to embodiments described herein may be configured as an integrated unit which provides for improving user confidence concerning the authenticity of the product. Further, compared to the state of the art, particle release into the environment can be reduced or even eliminated. Yet further, embodiments of the present disclosure provide for the possibility to implement services linked to the code.

According to an embodiment, which can be combined with other embodiments described herein, storing the product information associated with the code may comprise adding a record to a blockchain. The blockchain record may comprise a cryptographic hash of the previous block, a timestamp, the product information and/or the code. Advantageously, the information associated with the code cannot be modified and is as such persistent, until an update of the product information is added as a new record to the blockchain. Access to the block chain may be limited to authorised users only. According to embodiments, the information on the blockchain regarding the product may be updated when the product is sold. That has the advantage that the product is tamper-proved by the blockchain, as for example a carton of the product may not be reused for a counterfeit product. Further advantageously, the information that the product has been sold cannot be changed and thus may add a new layer product safety for the consumer.

According to an embodiment, which can be combined with other embodiments described herein, the cartoning machine system may comprise a verification module, wherein the verification module is adapted to check and/or to verify whether a product has been cartoned in the correct carton. A verification module may for example comprise a camera that is adapted for e.g. optical character recognition (OCR), the scanning of a code, or the recognition of a size of the product (image recognition). The verification module may for example comprise a scale adapted to determine the correct weight of the product in the carton. Advantageously, a verification module may guarantee that the correct product is cartoned in its respective carton. A further advantage may for example be that the cartoning machine system can be flexibly used in a continuous production. Further advantageously, the cartoning machine system may be used to carton different products to different cartons on the same machine, such as e.g. in a continuous production. According to an embodiment, which can be combined with other embodiments described herein, the register module and the verification module may work together to ensure that the correct product is cartoned in the correct carton. Advantageously, the register module and the verification module may increase the reliability of the system, particularly in a continuous production (with different products being fed into the system). Further advantageously, the register module and the verification module may allow for a higher flexibility of the system, such as e.g. handling different products at the same time or in a consecutive manner, particularly in a continuous manner.

According to embodiments, which can be combined with other embodiments described herein, the cartoning machine system is adapted to operate according to embodiments or a combination of embodiments of the method as described above or below. Providing a code associated with product information without adding a package insert into the packaging of a product reduces the time needed to package a product. Accordingly, beneficially the cartoning machine may be rated at a higher throughput performance and efficiency can be improved.

According to embodiments, which can be combined with other embodiments described herein, the code may be scanned by a dedicated application on a (private) computer or by a dedicated application on a smart device of a patient or a clerk in a pharmacy or at a point of care, in order to retrieve the product information associated with the code. The product information associated with the code may also be available on a website that can access the product information associated with the code on a server or a distributed service, such as a cloud service. The product information may then be available to be printed by the patient or the clerk in the pharmacy. This has the advantage, that up to date information (product information) is available at any time the code is scanned and that out of date information, such as old information printed on paper, e.g. on a package insert, is prevented from being on the market or from being read by a patient or clerk in the pharmacy. Advantageously, misinformation may be prevented and thereby a health risk for a user of the product may be reduced.

According to an embodiment, which can be combined with other embodiments described herein, the cartoning machine system may comprise an augmented reality device configured to detect the code on a carton or a product. The augmented reality device may further be configured to retrieve the information (product information) associated with the detected code and to display the information. Information may be displayed in an augmented manner in the field of view of the user of the augmented reality device. The augmented reality device may be configured to selectively detect a code on a plurality of cartons within the field of view of the augmented reality device. An augmented reality device may for example be a smart phone or a dedicated augmented reality goggle. Advantageously, the augmented reality device may provide the information associated with the detected code whenever the product (in the carton) is used.

According to an embodiment, which can be combined with other embodiments described herein, the method may comprise detecting the code. The code may be detected by for example a scanner, a smart phone, a camera or an augmented reality device.

According to an embodiment, which can be combined with other embodiments described herein, the method may comprise retrieving the information associated with the code. Retrieving the information may comprise authenticating with the computer, where the information associated with the code is stored. Retrieving the information may comprise downloading the information associated with the code. Advantageously, the information may only be retrieved by authorised users.

According to an embodiment, which can be combined with other embodiments described herein, the method may comprise display the retrieved information associated with the code on for example a smart phone, a (computer) display or with an augmented reality device. Advantageously, the information associated with the code may thus be readily available, whenever a code associated with (product) information is detected or scanned.

While the foregoing is directed to embodiments, other and further embodiments may be devised without departing from the basic scope, and the scope is determined by the claims that follow.

The invention claimed is:

1. A system for cartoning previously unpackaged medical products, comprising:

a cartoning machine system consisting of:

a product input module for introducing a product into the cartoning machine system;

a product processing module, wherein the product processing module receives at least one product from the product input module, sorts and/or measures a number of the at least one product to be placed into a first packaging, and wherein the product processing module is configured to process the at least one product by packaging the sorted and/or measured number of the at least one product in the first packaging to produce at least one processed product comprising the sorted and/or measured number of the at least one product in the first packaging;

a product cartoning module configured to provide a second packaging to one or more of the at least one processed product, said second packaging comprising a carton, to obtain at least one cartoned processed product; and a product information module configured to print a code on at least one of the product and the first packaging of the at least one processed product; and wherein the cartoning machine system is without a package insert inserting module for inserting a package insert into the carton of the at least one cartoned processed product.

2. The system for cartoning previously unpackaged medical products according to claim 1, wherein the cartoning machine system is further without a folding machine module for providing a package insert into the carton of the at least one cartoned processed product.

3. The system for cartoning previously unpackaged medical products according to claim 1, further comprising a computer adapted to store, to provide information associated with the code, or to store and to provide information associated with the code.

4. The system for cartoning previously unpackaged medical products according to claim 1, wherein the code is a readable code.

5. The system for cartoning previously unpackaged medical products according to claim 1, wherein the code provides product information related to the at least one cartoned processed product.

6. The system for cartoning previously unpackaged medical products according to claim 1, wherein the product information module further consists of at least one module selected from the group consisting of a lasing module or a printing module for lasing or printing the code on the product, and the processed product.

7. The system for cartoning previously unpackaged medical products according to claim 1, wherein the product information module further consists of a labelling module for labeling the code onto the first packaging of the processed product.

8. The system for cartoning previously unpackaged medical products according to claim 1, wherein the cartoning machine system is adapted for use in a clean room environment.

9. The system for cartoning previously unpackaged medical products according to claim 1, wherein the product input module further consists of a register module for obtaining one or more parameters from the at least one product.

10. The system for cartoning previously unpackaged medical products according to claim 9, wherein the register module consists of a camera system or a mechanical sensing system for analyzing the at least one product for obtaining the one or more parameters.

11. The system for cartoning previously unpackaged medical products according to claim 9, wherein the one or more parameters obtained from the at least one product consists of at least one parameter selected from the group consisting of amount, size, shape and optical properties, and combinations thereof.

12. The system for cartoning previously unpackaged medical products according to claim 1, wherein the product input module is configured to assort more than one products when more than one of the at least one product is introduced into the product input module.

13. The system for cartoning previously unpackaged medical products according to claim 1, wherein the cartoning machine system is configured to not provide a package insert into the carton of the at least one cartoned processed product.

14. A method for cartoning a previously unpackaged medical product, comprising:

acquiring product entity information, the product entity information being representative for a product to be cartoned;

determining a code based on the product entity information;

providing a cartoning machine system consisting of:

a product input module;

a product processing module;

a product cartoning module; and a product information module; and wherein the product input module introduces the product into the cartoning machine system;

wherein the product processing module receives the product from the product input module, sorts and/or measures a number of the product to be placed into a first packaging, and wherein the product processing module is configured to process the product by packaging the sorted and/or measured number of the product in the first packaging to produce at least one processed product comprising the sorted and/or measured number of the product in the first packaging;

wherein the product cartoning module is configured to provide a second packaging to one or more of the processed product, said second packaging comprising a carton, to obtain at least one cartoned processed product;

wherein the product information module is configured to print the code on at least one of the product and the first packaging of the at least one processed product; and wherein the one or more of the processed product are packaged into the carton without including a package insert into the carton.

15. The method for cartoning a previously unpackaged medical product according to claim 14, wherein the method further comprises issuing the code to a computer.

16. The method for cartoning a previously unpackaged medical product according to claim 15, wherein the method further comprises determining a product information to be provided with the code by the computer and storing the product information associated with the code.

17. The method for cartoning a previously unpackaged medical product according to claim 16, further comprising updating the product information linked to the code.

18. The method for cartoning a previously unpackaged medical product according to claim 14, wherein printing the code comprises at least one of lasing, printing and engraving.

19. The method for cartoning a previously unpackaged medical product according to claim 14, wherein determining of the code further comprises determining of an encoding scheme for the code for providing product tamper proofing.

20. The previously unpackaged medical method for cartoning a product according to claim 14, further comprising not providing a package insert into the cartoned processed product.

* * * * *